United States Patent [19]

Gauld

[11] Patent Number: 4,462,901

[45] Date of Patent: Jul. 31, 1984

[54] APPARATUS FOR SCREENING FIBROUS STOCK

[76] Inventor: W. Thomas Gauld, 4313 Winding Way, Mobile, Ala. 36609

[21] Appl. No.: 335,246

[22] Filed: Dec. 28, 1981

[51] Int. Cl.[3] ..... B07B 9/00; B07B 1/20

[52] U.S. Cl. ..... 209/234; 209/273; 209/306; 209/389

[58] Field of Search ..... 209/271, 273, 234, 305, 209/306, 385, 389

[56] References Cited

U.S. PATENT DOCUMENTS

| | | | |
|---|---|---|---|
| 1,437,720 | 12/1922 | Chapman | 209/273 |
| 1,556,372 | 10/1925 | Thaler | 209/273 |
| 2,230,647 | 2/1941 | Knight | 209/385 |
| 2,246,669 | 6/1941 | Cowan | 209/273 |
| 3,539,008 | 11/1970 | McKibben | 209/234 |
| 3,755,072 | 8/1973 | Östberg et al. | 209/389 |
| 3,785,495 | 1/1974 | Holz | 209/273 |
| 4,222,864 | 9/1980 | Keller | 209/306 |
| 4,234,417 | 11/1980 | Gauld et al. | 209/306 |

*Primary Examiner*—David L. Lacey
*Attorney, Agent, or Firm*—Walker & McKenzie

[57] ABSTRACT

An apparatus for screening fibrous stock. The apparatus includes a preliminary screen, a rotor, and a cylindrical secondary screen. The stock first passes through the preliminary screen into the rotor and secondary screen. The preliminary filtered stock then passes through the secondary screen. Any stock not passing through the preliminary or secondary screens is discharged from the apparatus.

8 Claims, 3 Drawing Figures

APPARATUS FOR SCREENING FIBROUS STOCK

BACKGROUND OF THE INVENTION

1. Field of the Invention:

The present invention relates to apparatuses for and methods of filtering fibrous stock slurry.

2. Description of the Prior Art:

Gauld et al, U.S. Pat. No. 4,234,417 discloses a fibrous stock screen comprising, in general, a hollow housing member, a cylindrical, open-ended screen member positioned within the housing member and dividing the interior of the housing member into first and second chambers; and an impeller means for causing fibrous stock within the first chamber to pass through the screen member into the second chamber. U.S. Pat. No. 4,234,417 does not disclose or suggest the improvement of the present invention.

SUMMARY OF THE INVENTION

The present invention is directed toward improving upon prior apparatuses for filtering fibrous stock slurry. The concept of the present invention is to provide a single fibrous stock screening apparatus which will accomplish a plurality of screening steps (e.g., a course screening step and a fine screening step). The apparatus of the present invention includes, in general, a hollow housing member having an inlet port for allowing fibrous stock to be introduced into the interior thereof and having first and second outlet ports for allowing screened fibrous stock to be discharged therefrom; cylindrical, open-ended screen member positioned within the housing member for dividing the interior of the housing member into first and second chambers; a screen means for dividing the first chamber into first and second portions; and an impeller means for causing fibrous stock within the first chamber to pass through the screen member into the second chamber and/or out the outlet ports.

DESCRIPTION OF THE PREFERRED EMBODIMENT

Figure 1:
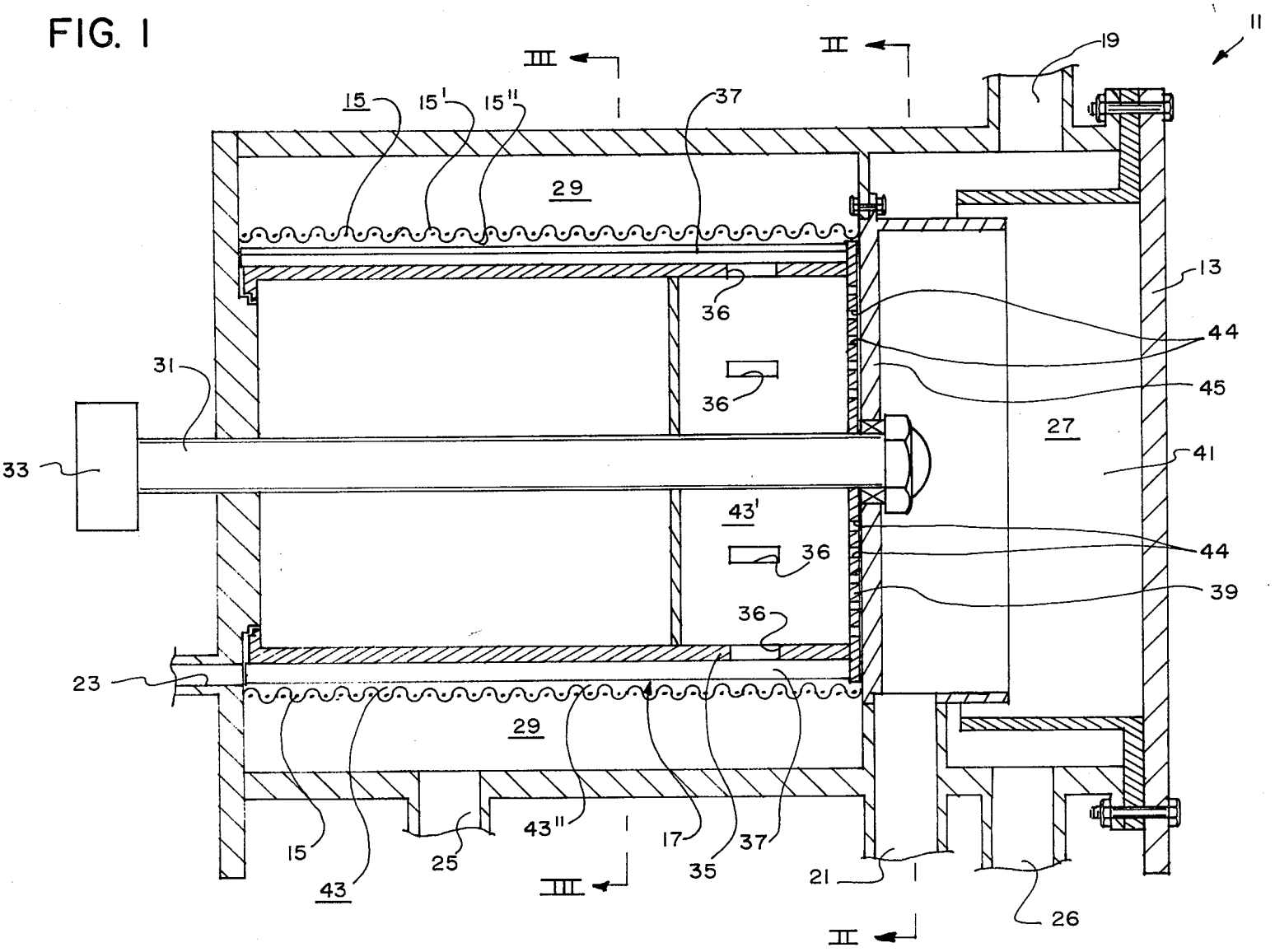
FIG. 1 is a somewhat schematic sectional view of screening apparatus of the present invention.

The apparatus 11 of the present invention is for screening fibrous stock slurry in order to separate the slurry into different grades and to remove any unacceptable, substantially large, substantially solid material therefrom. The apparatus 11 includes, in general, a hollow housing member 13; a cylindrical, open-ended screen member 15 positioned within the housing member 13; and an impeller means 17 for causing fibrous stock to pass through the screen member 15.

The housing member 13 has an inlet port 19 for allowing fibrous stock to be introduced into the interior thereof. The housing member 13 also has a first or initial outlet port 21, a second outlet port 23, and a third or final outlet port 25 for allowing screened fibrous stock to be discharged therefrom and may have a waste outlet port 26 for allowing waste or any unacceptable material in the slurry to be discharged from the housing member 13.

The screen member 15 may be constructed of a metal plate having an outer side 15' and an inner side 15" and having a plurality of apertures therethrough of a size for allowing acceptable portions of the fibrous stock to pass therethrough. The housing member 13 preferably includes structure means for fixedly mounting the screen member 15 within the interior of the housing member 13 and for isolating the outer side 15' of the screen member 15 to divide the interior of the housing member 13 into a first chamber 27 and a second chamber 29 with the boundary between the first and second chambers 27, 29 defined in part by the screen member 15.

The impeller means 17 includes a rotatable shaft member 31 extending at least partially through the interior of the housing member 13 substantially along the longitudinal axis of the screen member 15. The shaft member 31 is preferably rotatably driven in any manner apparent to those skilled in the art such as by being directly or indirectly coupled to the output shaft of an electric motor 33. The impeller means 17 also includes a rotor means. The rotor means includes a cylindrical body member 35 fixedly attached to the shaft member 31 within the screen member 15 for being rotated by the shaft member 31. The body member 35 is provided with large openings 36 at one end thereof for reasons which will hereinafter become apparent. The rotor means also includes a plurality of blade members 37 attached to and spaced substantially evenly about the circumference of the body member 35 and radiating outwardly therefrom in the general configuration shown in the drawings.

Figure 2:
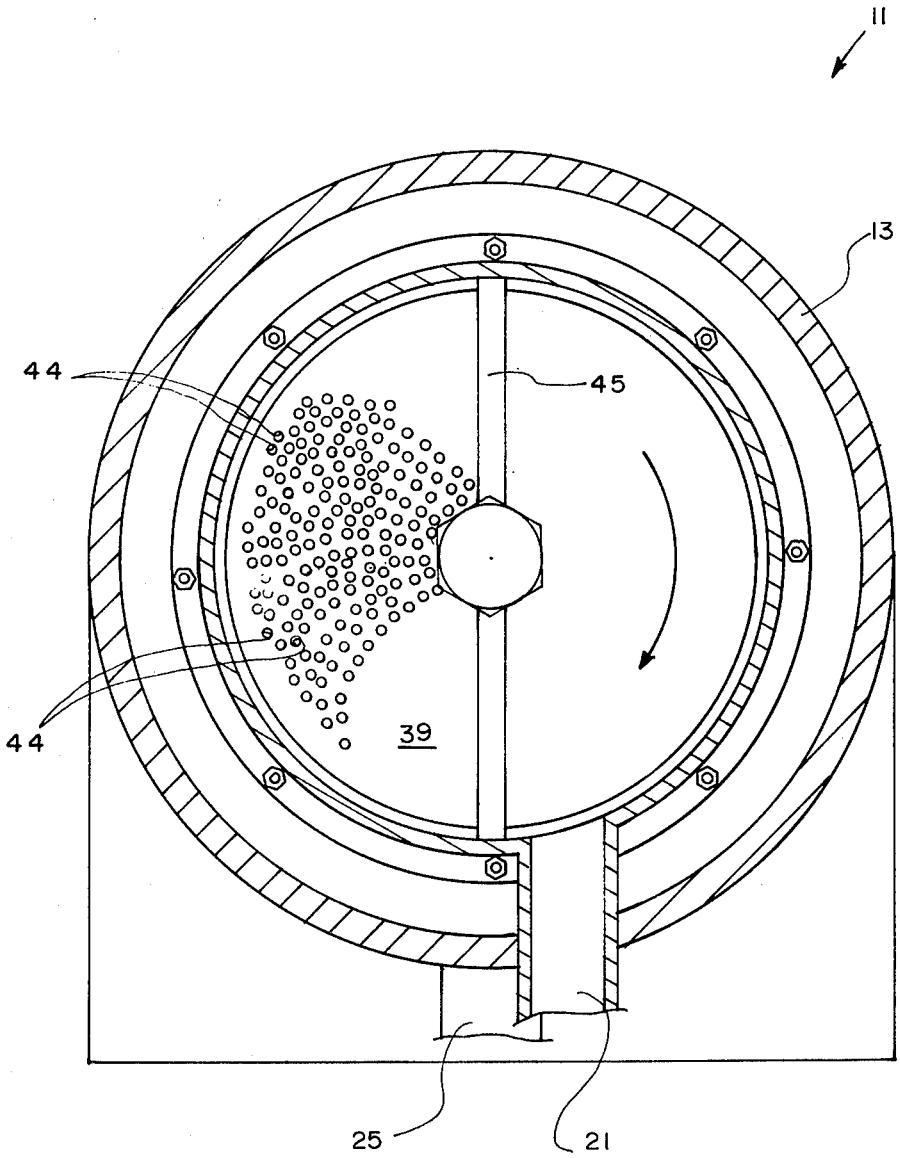
FIG. 2 is a sectional view substantially as taken on line II—II of FIG. 1 with portions thereof shown schematically for clarity.
Figure 3:
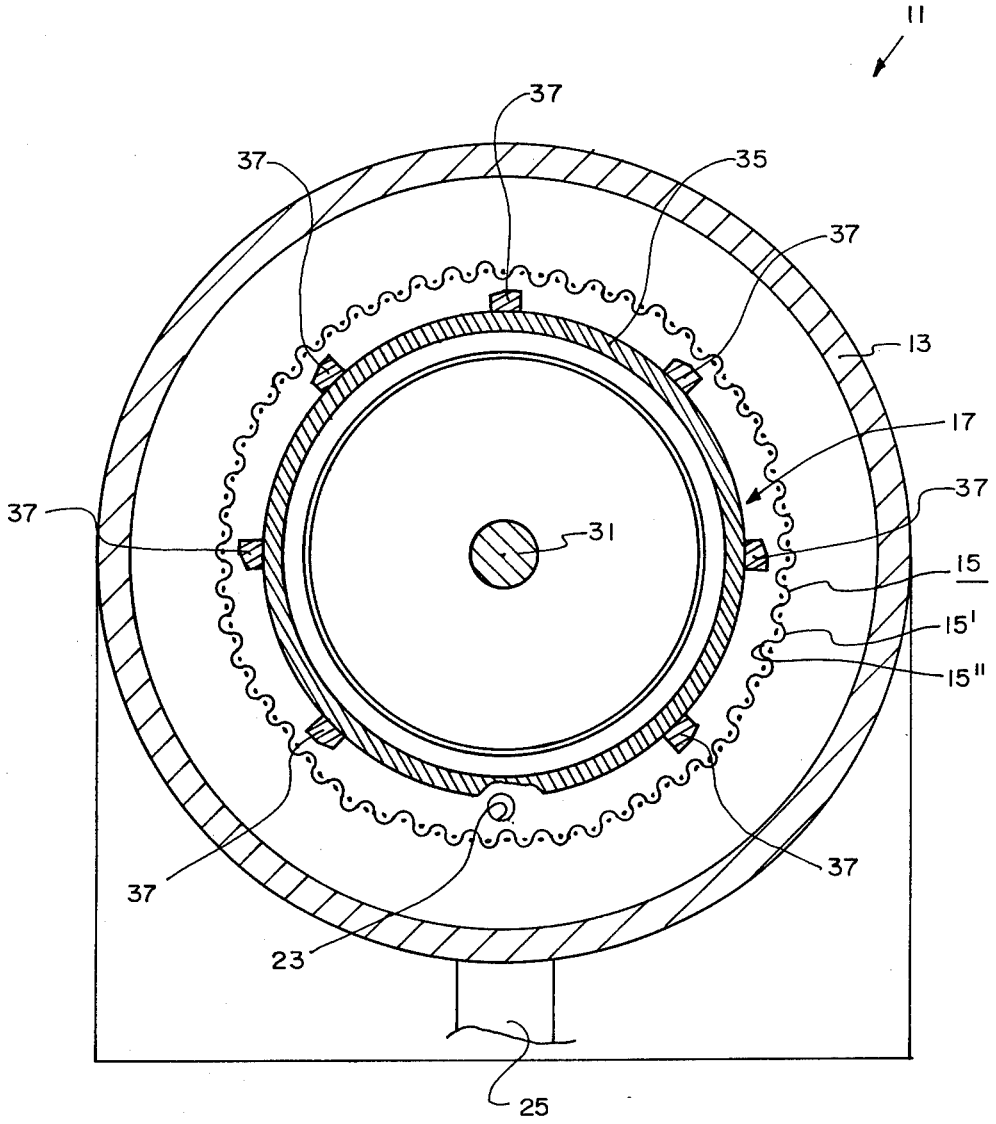
FIG. 3 is a sectional view substantially as taken on line III—III of FIG. 1.

The improvement of the apparatus 11 includes a screen means 39 for dividing the first chamber 27 into a first portion 41 and a second portion 43. The screen means 39 is preferably platelike and preferably covers one end of the body member 35 whereby the body member 35 is located within the second portion 43 of the first chamber 27. The screen means 39 has a plurality of apertures 44 therethrough of a size somewhat larger than the apertures through the screen member 15 for allowing portions of the fibrous stock to pass therethrough. The apertures 44 through the screen means 39 may be arranged in a somewhat spiral pattern as shown in FIG. 2 (Note: for reasons of clarity, the apertures 44 are shown only on a portion of the screen means 39 in FIG. 2. However, it is intended that the apertures 44 be evenly distributed over the entire area of the screen means 39). As clearly shown in FIG. 1, the apertures 44 in the screen means 39 allows portions of the fibrous stock to pass into an initial portion 43' of the second portion 43 of the first chamber 27 that is defined by one end of the body member 35. The openings 36 in the body member 35 allow the fibrous stock to exit the portion 43' and pass into a secondary portion 43" thereof as will now be apparent to those skilled in the art.

The inlet port 19 communicates with the first portion 41 of the first chamber 27 for allowing fibrous stock to be introduced into the first portion 41 of the first chamber 27. The first outlet port 21 communicates with the first portion 41 of the first chamber 27 for allowing fibrous stock of a size that will not pass through the screen means 39 to be discharged from the first portion 41 of the first chamber 27 and out of the apparatus 11. The second outlet port 23 communicates with the second portion 43 of the first chamber 27 for allowing fibrous stock of a size that will pass through the screen means 39 but not through the screen member 15 to be discharged from the second portion 43 of the first chamber 27 and out of the apparatus 11. The third outlet port 25 communicates with the second chamber 29 for allowing fibrous stock of a size that will pass through the screen means 39 and the screen member 15 to be discharged from the second chamber 29 and out of the apparatus 11.

The apparatus 11 preferably includes a wiper or blade means 45 positioned within the first portion 41 of the first chamber 27 adjacent the screen means 39 for directing, or wiping, any fibrous stock in the first portion 41 of the first chamber 27 that will not pass through the screen means 39 away from the screen means 39 and toward the first outlet port 21. The blade means 45 and screen means 39 rotate relative to one another. Preferably, the blade means 45 is stationarily supported by the structure means of the housing member 13 and the screen means 39 is attached to the shaft member 31 of the impeller means 17 for rotation therewith. The blade means 45 is positioned closely adjacent the screen means 39 so as to wipe any fibrous stock that will not pass through the apertures 44 in the screen means 39 away from the screen means 39.

The apparatus 11 may include various other features and may be constructed in various manners as will be apparent to those skilled in the art. See, for example, Gauld et al, U.S. Pat. No. 4,234,417 which discloses an apparatus for screening fibrous stock of the same basic type as the present invention.

The basic operation of the apparatus 11 of the present invention is quite simple. Fibrous stock is introduced into the first portion 41 of the first chamber 27 in any manner apparent to those skilled in the art. Certain waste material and the like will pass through the waste outlet port 26, as will be apparent to those skilled in the art. Rotation of the impeller means 17 will cause the fibrous stock to be drawn through the screen means 39 from the first portion 41 and into the initial portion 43' of the second portion 43 of the first chamber 27 whereby a first screening step (i.e., a rough screening step) takes place. The rotation of the screen means 39 and the blade means 45 relative to one another will cause any fibrous stock of a size that will not pass through the screen means 39 (i.e., a first grade of screened stock) to be discharged through the first outlet port 21. Continued rotation of the impeller means 17 will cause fibrous stock to pass through the openings 36 in the body member 35 from the initial portion 43' of the second portion 43 of the second chamber 27, into the secondary portion 43'' of the second portion 43 of the first chamber 27, and then through the screen member 15 into the second chamber 29. Any portion of the fibrous stock that will not pass through the screen member 15 (i.e., a second grade of screened stock) will be discharged from the second portion 43 of the first chamber 27 through the outlet port 23 whereby a second screening step takes place. The fibrous stock that passes through the screen member 15 into the second chamber 29 (i.e., a third grade of screened stock) is discharged from the second chamber 29 through the outlet port 25 whereby a third screening step takes place. Reference should be made to Gauld, U.S. Pat. No. 4,234,417 for a more complete understanding of the operation and various features and construction of a basic apparatus for screening fibrous stock.

Although the invention has been described and illustrated with respect to a preferred embodiment thereof, it is not to be so limited since changes and modifications may be made therein which are within the full intended scope of the invention.

I claim:

1. An improved apparatus for screening fibrous stock of the type including a hollow housing member having an inlet port for allowing fibrous stock to be introduced into the interior thereof and having an outlet port for allowing screen fibrous stock to be discharged therefrom; a cylindrical, open-ended screen member positioned within said housing member; said housing member including structure means for fixedly mounting said screen member within said housing member and for isolating the outer side of said screen member to divide the interior of said housing member into a first chamber and a second chamber with the boundary between said first and second chambers defined in part by said screen member, said inlet port communicating directly with said first chamber and said outlet port communicating directly with said second chamber; a rotatable shaft member located substantially along the longitudinal axis of said screen member; a rotor means for causing fibrous stock within said first chamber to pass through said screen member into said second chamber and out said outlet port, said rotor means including a cylindrical body member fixedly attached to said shaft member for rotation therewith and including a plurality of blade members attached to and spaced about the circumference of said body member and radiating outwardly therefrom, said blade members being spaced from said screen member to permit the forming of a mat of stock between said blade members and said screen member; wherein the improvement comprises: screen means for dividing said first chamber into a first portion and a second portion, said housing member including an outlet port communicating with said first portion of said first chamber for allowing fibrous stock to be discharged from said first portion of said first chamber; and a blade means positioned within said first portion of said first chamber adjacent said screen means for wiping any fibrous stock in said first portion of said first chamber that will not pass through said screen means toward said outlet port communicating with said first portion of said first chamber; said screen means being platelike and covering one end of said cylindrical body member, said blade means extending across said screen means from one side to the other through the center thereof.

2. The improved apparatus of claim 1 further including means for causing said screen means and said blade means to rotate relative to one another.

3. The improved apparatus of claim 2 in which said screen means is attached to said shaft member for rotation therewith, and in which said blade means is stationarily supported by said structure means.

4. The improved apparatus of claim 3 in which said screen means has relatively large apertures therethrough, said apertures through said screen means being arranged in a spiral pattern, and in which said screen member has relatively small apertures therethrough.

5. An apparatus for screening fibrous stock, said apparatus comprising: a hollow housingg member having an inlet port for allowing fibrous stock to be introduced into the interior thereof and having an initial outlet port and a final outlet port for allowing screened fibrous stock to be discharged therefrom; a cylindrical, open-ended screen member positioned within said housing member; said housing member including structure means for fixedly mounting said screen member within said housing member and for isolating the outer side of said screen member to divide the interior of said housing member into a first chamber and a second chamber with the boundary between said first and second chambers defined in part by said screen member; a screen means positioned in said first chamber so as to divide said first chamber into first and second portions, said screen means being platelike and being positioned and arranged to cover one of the open ends of said screen member and to rotate therewith, said inlet port and said initial outlet port communicating directly with said first portion of said first chamber and said final outlet port communicating directly with said second chamber; an impeller means for causing fibrous stock within said first chamber to pass through said screen member into said second chamber and out said final outlet port, said impeller means including a rotatable shaft member located substantially along the longitudinal axis of said screen member and including a rotor means located in said second position of said first chamber, said rotor means including a cylindrical body member fixedly attached to said shaft member for rotation therewith and including a plurality of blade members attached to and spaced about the circumference of said body member and radiating outwardly therefrom, said blade members being spaced from said screen member to permit the forming of a mat of stock between said blade members and said screen member; and a blade means positioned within said first portion of said first chamber adjacent said screen means for directing any fibrous stock in said first portion of said first chamber that will not pass through said screen means toward said initial outout port.

6. The apparatus of claim 5 further including means for causing said screen means and said blade means to rotate relative to one another.

7. The apparatus of claim 6 in which said screen means is attached to said shaft member for rotation therewith, and in which said blade means is stationarily supported by said structure means.

8. The apparatus of claim 7 in which said screen means has relatively large apertures therethrough, and in which said screen member has relatively small apertures therethrough.

* * * * *